United States Patent [19]

Okuda

[11] Patent Number: 4,558,683

[45] Date of Patent: Dec. 17, 1985

[54] IGNITION SYSTEM IN INTERNAL COMBUSTION ENGINE

[75] Inventor: Hiroshi Okuda, Hyogo, Japan

[73] Assignee: Mitsubishi Denki Kabushiki Kaisha, Tokyo, Japan

[21] Appl. No.: 746,463

[22] Filed: Jun. 20, 1985

Related U.S. Application Data

[63] Continuation of Ser. No. 545,976, Oct. 27, 1983, abandoned.

[30] Foreign Application Priority Data

Oct. 27, 1982 [JP] Japan ..... 57-190639
Jun. 22, 1983 [JP] Japan ..... 58-113174

[51] Int. Cl.[4] ..... F02D 3/06

[52] U.S. Cl. ..... 123/599; 123/596; 123/633; 123/602

[58] Field of Search ..... 123/599, 596, 633, 602; 307/252 J, 252 K

[56] References Cited

U.S. PATENT DOCUMENTS 3,933,139 1/1976 Beeghly ..... 123/599
3,960,129 6/1976 Hofer et al. ..... 123/599
4,007,724 2/1977 Mura ..... 123/599
4,188,929 2/1980 Podrapsky et al. ..... 123/599
4,324,215 4/1982 Sieja ..... 123/599
4,413,608 11/1983 Beeghly ..... 123/599

*Primary Examiner*—Raymond A. Nelli
*Attorney, Agent, or Firm*—Sughrue, Mion, Zinn, Macpeak & Seas

[57] ABSTRACT

An ignition system for an outboard internal combustion engine in which the ignition timing is controlled by the throttle setting of the engine. The system includes a signaling coil, which forms a part of a magneto, a thyristor switch for discharging a capacitor which is charged by a generating coil of the magneto to supply ignition current to an ignition coil, and a delay circuit connected between the signaling coil and the thyristor switch. The delay circuit is reset every period of the output of the generating coil, so that, even when the engine rotates at a high speed, the delay operation is positively carried out. As a result, the ignition timing is maintained substantially unchanged irrespective of the speed of the engine, and electromagnetic noise from the signaling coil is greatly suppressed.

7 Claims, 14 Drawing Figures

IGNITION SYSTEM IN INTERNAL COMBUSTION ENGINE

This is a continuation of application Ser. No. 545,976, filed 10/27/83, now abandoned.

BACKGROUND OF THE INVENTION

The present invention relates to an ignition system for an internal combustion engine which operates with a capacitor which is charged by a magneto. More particularly, the invention relates to an ignition system for an internal combustion engine in which the ignition timing is maintained substantially unchanged, irrespective of the speed of the engine.

In general, in an ignition system using a magnetic generator as its power source, the ignition timing advances with the speed of the engine because the output of the magneto, which is turned by the engine, increases as the speed of the engine increases. Advancement of the ignition timing is suitable for an internal combustion engine used in a garden tractor or the like, but it is not suitable for an outboard internal combustion engine in which the ignition timing is advanced by turning the stator of the magneto in association with the throttle. That is, the position of the stator of the magnetic generator should be determined according to the degree of opening of the throttle for best results. Therefore, if the ignition system has an ignition timing advance characteristic, the ignition timing may be shifted from the best position. Because of this, in an ignition system used in an outboard internal combustion engine, it is required that the ignition timing be maintained constant, irrespective of the speed of rotation of the engine.

On the other hand, in order to eliminate electromagnetic noise produced by the magneto, it has been known to connect a capacitor between the gate and the cathode of the thyristor rectifying the output of the magneto. The noise component may be eliminated more effectively by high values. However, if the capacitance value is too high, when the engine rotates at high speeds, the capacitor will not be completely discharged for every period, and the effect of eliminating noise is lowered. In addition, as the thyristor is continuously triggered by the voltage remaining in the capacitor, the output of the generating coil will be short circuited by the thyristor, and accordingly no ignition voltage produced. Because of such a limitation, heretofore the capacitance of the noise eliminating capacitor is typically limited to 0.047 $\mu$F to 0.1 $\mu$F. Thus the conventional method is insufficient to effectively eliminate electromagnetic noise, especially low-frequency, high-level noise.

SUMMARY OF THE INVENTION

Overcoming the drawbacks of the prior art, the invention provides an ignition system for an internal combustion engine which comprises a generating coil and a signaling coil for generating AC outputs in synchronization with rotation of the engine; an ignition coil; a first capacitor charged by an output of the generating coil; first switching means which, when rendered conductive, discharges the first capacitor to operate the ignition coil; and a delay circuit including a resistor and a second capacitor, for delaying the output of the signaling coil, which is then applied to the first switching means to render the first switching means conductive; and second switching means which, after the first capacitor is discharged, is rendered conductive by the outputs of the generating coil and signal coil to reset the delay circuit. The delay circuit is reset for every period of the output of the signaling coil so that, even when the engine is rotating at a high speed, the delay operation is positively carried out so as to maintain the ignition timing substantially unchanged. With this system, the effect of eliminating noise is remarkably improved.

The foregoing object and other objects as well as the characteristic features of the invention will become more apparent from the following detailed description and the appended claims when read in conjunction with the accompanying drawings, in which like parts are designated by like reference numerals or characters.

BRIEF DESCRIPTION OF THE DRAWINGS

In the accompanying drawings

DESCRIPTION OF THE PREFERRED EMBODIMENTS

Preferred embodiments of the invention will now be described with reference to the accompanying drawings.

Figure 1:
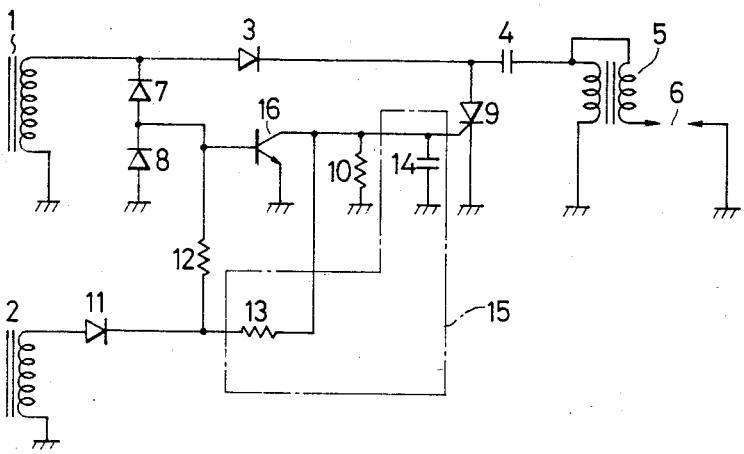
FIG. 1 is a circuit diagram of a first embodiment of an ignition system of the invention.

A first embodiment of an ignition system of the invention is shown in FIG. 1. In FIG. 1, reference numeral 1 designates a generating coil of a magneto, the latter being driven by an engine (not shown) to generate an AC output in synchronization with the rotation of the engine; 2, a signalling coil which also forms a part of the magneto; 3, a diode for rectifying the AC output of the generating coil 1; 4, a first capacitor which is charged by the rectified output from the diode 3; 5, an ignition coil operated by the voltage of the capacitor 4; 6, a spark plug in which spark discharge is caused by the secondary voltage of the ignition coil 5; 7 and 8, diodes for short-circuiting the half of each cycle of the AC output of the generating coil which does not contribute to the charging of the capacitor 4; 9, a thyristor which is triggered by the ignition signal output of the signaling coil with the engine ignition timing to discharge the capacitor 4, thereby to activate the ignition coil 5; and 10, a resistor connected between the gate and the cathode of the thyristor 9 to bias the gate of the thyristor 9. Further in FIG. 1, reference numeral 11 designates a diode for rectifying the AC output of the signaling coil 2; 12 and 13, resistors for limiting the rectified output current of the signaling coil 2; 14, a second capacitor connected between the gate and the cathode of the thyristor 9, the capacitor 14 and the resistor 13 forming a delay circuit 15; and 16, a transistor connected to shunt the capacitor 14, the transistor 16 being turned on and off by the signal output of the signaling coil 2 and the AC output of the generating coil 1.

The operation of the ignition system thus constructed will be described.

The AC output of the generating coil 1 is rectified by the diode 3, thus charging the capacitor 4. Of each cycle of the output of the generating coil 1, the half cycle which does not contribute to the charging of the capacitor 4 is short circuited by the diodes 7 and 8. The thyristor 9 is rendered conductive by pulses derived from the signaling coil to thereby discharge and the capacitor 4 and to thus operate the ignition coil 5. When the charge of the capacitor 4 is applied to the primary winding of the ignition coil 5, a high voltage is induced in the secondary winding to thus produce a spark by the spark plug 6.

The output of the signaling coil 2 is rectified by the diode 11, and is then supplied through the delay circuit 15, composed of the resistor 13 and the capacitor 14, to the gate of the thyristor 9. In this operation, the capacitor 14 is charged through the resistor 13, and therefore the terminal voltage of the capacitor 14 increases accordingly. When the terminal voltage reaches the gate trigger voltage $V_{GT}$ of the thyristor 9, the thyristor 9 is rendered conductive. As a result, the capacitor 4 is discharged and a spark is produced by the spark plug. The output of the signaling coil 2, rectified by the diode 11, is further supplied through the resistor 12 to the transistor 16. The base of the transistor 16 is connected to the connection point of the diodes 7 and 8, which perform the function of short circuiting the negative half waves of the output of the generating coil 1. Accordingly, the transistor 16 is turned on and off by both outputs of the generating coil 1 and the signaling coil 2.

When the transistor 16 is rendered conductive, the capacitor 14 is short circuited thereby; that is, the capacitor 14 is discharged, as a result of which the delay circuit 15 is reset. The transistor 16 is rendered conductive only when the output voltage of the generating coil 1 is zero or positive and the output voltage of the signaling coil 2 is positive. For the period of time during which the output voltage of the generating coil 1 is negative, the short circuit current flows in the diodes 7 and 8, as a result of which a forward voltage drop $V_F$ across the diode 8 reversely biases the base-emitter of the transistor 16, holding off the transistor 16. For the period of time during which the output voltage of the signaling coil 2 is not positive, no voltage which would turn on the transistor 16 is supplied to the base of the transistor 16, and accordingly the transistor 16 is maintained off.

Figure 2:
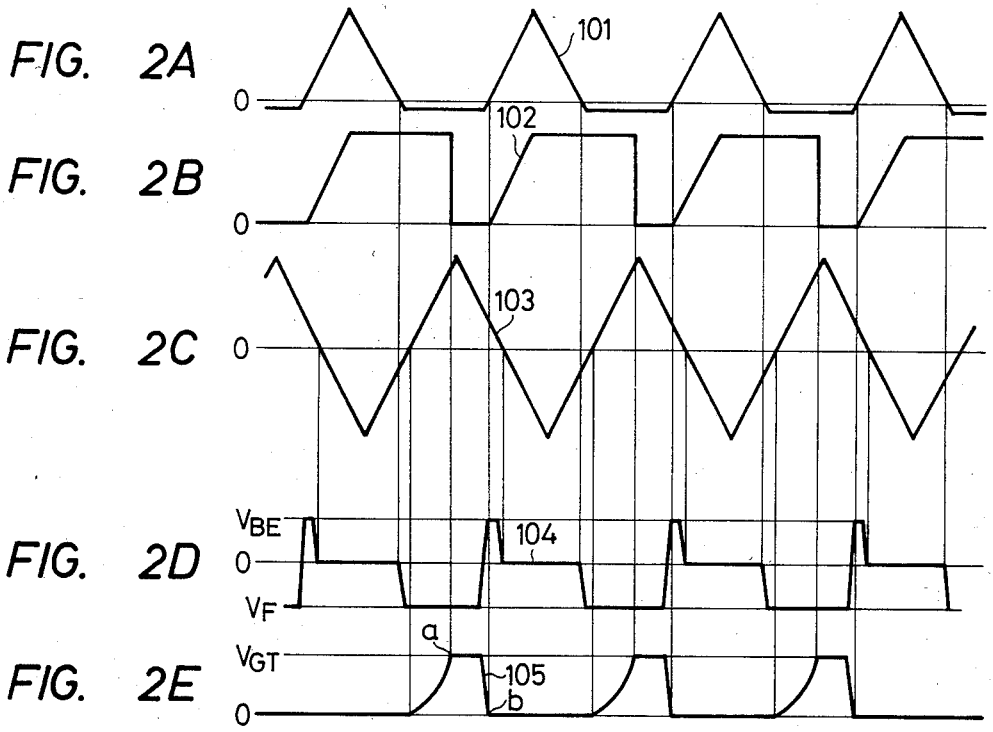
FIGS. 2A through 2E, taken together, are a waveform diagram used for a description of the operation of the ignition system of FIG. 1.

FIGS. 2A through 2E, taken together, are a waveform diagram used for a description of the operation of the above-described ignition system. FIG. 2A shows the AC output voltage waveform 101 of the generating coil 1, FIG. 2B the terminal voltage waveform 102 of the capacitor 4, FIG. 2C the AC output voltage waveform 103 across the signaling coil 2; FIG. 2D the base-emitter voltage waveform 104 of the transistor 16, and FIG. 2E the gate-cathode voltage waveform 105 of the thyristor 9. Further, in this diagram, $V_{BE}$ designates the base-emitter forward voltage drop of the transistor 16; $V_F$, the forward voltage drop of the diode 8; and $V_{GT}$ the gate trigger voltage of the thyristor 9.

When the output voltage waveform 103 of the signaling coil 2 rises, the gate-cathode voltage waveform 105 of the thyristor rises also. However, the rise of the waveform 105 is delayed by the delay circuit 15, and the thyristor 9 is triggered at the point a. The amount of delay of the waveform is increased as the speed of rotation of the engine is increased. The reason for this is that, as the speed of the engine increases, the rate of rise of the waveform of the signal coil 2 increases, and accordingly the action of the delay circuit 15 becomes more effective. Only for the period of time during which the output of the generating coil 1 is zero or positive and the output of the signaling coil 2 is positive will the base-emitter voltage waveform 104 of the transistor 16 reach the value $V_{BE}$ and the transistor 16 be rendered conductive. Therefore, with respect to the gate-cathode voltage waveform 105 of the thyristor 9, the capacitor 14 is discharged at the point b, as result of which the delay circuit 15 is reset to be ready for the next output of the signaling coil 2.

As is apparent from the above description, in the first embodiment of the invention, the capacitor 14 in the delay circuit 15 is reset every period. Therefore, even when the engine rotates at a high speed, the difficulty that charges remain on the capacitor until the next period, and thus reducing the delay effect, is eliminated. That is, the delay operation is always positively carried out, so that the amount of delay (delay angle) increases as the engine speed increases.

Figure 3:
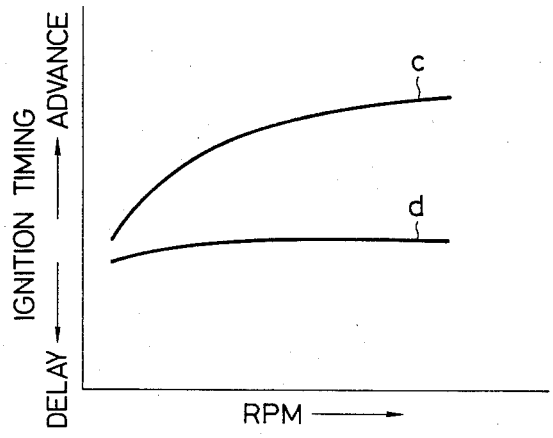
FIG. 3 is a characteristic diagram showing a conventional ignition timing characteristic curve and an ignition timing characteristic curve of the ignition system of the invention.

FIG. 3 shows ignition timing characteristic curves. In FIG. 3, curve c is a conventional ignition timing characteristic curve, and d an ignition timing characteristic curve for the above-described ignition system of the invention. It can easily be appreciated that, in the system of the invention, the ignition timing is substantially constant, irrespective of the speed of rotation of the engine, due to the delay effect of the delay circuit 15. This satisfies the conditions which are required for an outboard engine ignition system.

A second embodiment of the invention will be described with reference to FIG. 4.

Figure 4:
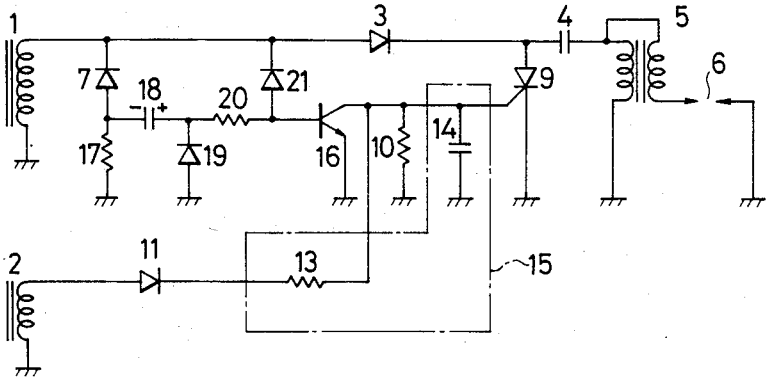
FIG. 4 is a circuit diagram showing a second embodiment of the invention.

In FIG. 4, reference numerals 1 through 7, 9 through 11 and 13 through 16 designate the same components as those in FIG. 1. Further in FIG. 4, reference numeral 17 designates a resistor which is employed instead of the diode 8 in FIG. 1; 18, a third capacitor which is charged by the half of each cycle of the AC output of the generating coil 1 which does not contribute to the charging of the capacitor 4; 20, a resistor through which the charges of the capacitor 18 are applied to the transistor 16; and 21, a diode for applying the half of each cycle of the AC output of the generating coil 1 which does not contribute to the charging of the capacitor 4 to the base of the transistor 16.

The operation of the second embodiment as shown in FIG. 4 will now be described.

The AC output of the generating coil 1 is rectified by the diode 3, thus charging the capacitor 4. Of each cycle of the output of the generating coil 1, the half cycle which does not contribute to the charging of the capacitor 4 is short circuited by the diode 7 and the resistor 17. The capacitor 4 is discharged through the thyristor 9, which is rendered conductive with the engine ignition timing, to operate the ignition coil 5. When the charge of the capacitor 4 is applied to the primary winding of the ignition coil 5, a high voltage is induced in the secondary winding, so that a spark is produced by the spark plug 6.

The output of the signaling coil 2 is rectified by the diode 11 and then applied through the delay circuit 15, composed of the resistor 13 and the capacitor 14, to the gate of the thyristor 9. In this operation, the capacitor 14 is charged through the resistor 13, and accordingly the terminal voltage of the capacitor 14 correspondingly increases. When the terminal voltage reaches the gate trigger voltage $V_{GT}$ of the thyristor 9, the thyristor 9 is rendered conductive. As a result, the capacitor 4 is discharged, and a spark is produced by the spark plug 6.

Of each cycle of the output of the generating coil 1, the half cycle (negative half cycle) which does not contribute to the charging of the capacitor 4 is short circuited by the diode 7 and the resistor 17. However, a voltage drop across the resistor 17 is applied through the diode 19 to the capacitor 18 so that the capacitor 18 is charged with the polarity indicated in FIG. 4. The charge of the capacitor 18 is applied through the resistor 20 to the base of the transistor 16, rendering the transistor 16 conductive. When the transistor 16 is turned on, the capacitor 14 is shorted thereby, discharging the capacitor 14 and resetting the delay circuit 15.

As described, the base of the transistor 16 is connected through the diode 21 to the generating coil 1. Thus, for a period of time during which the half cycle of each cycle of the output of the generating coil 1, the base-emitter of the transistor 16 is reversely biased, and the transistor 16 is held in the off state.

Figure 5:
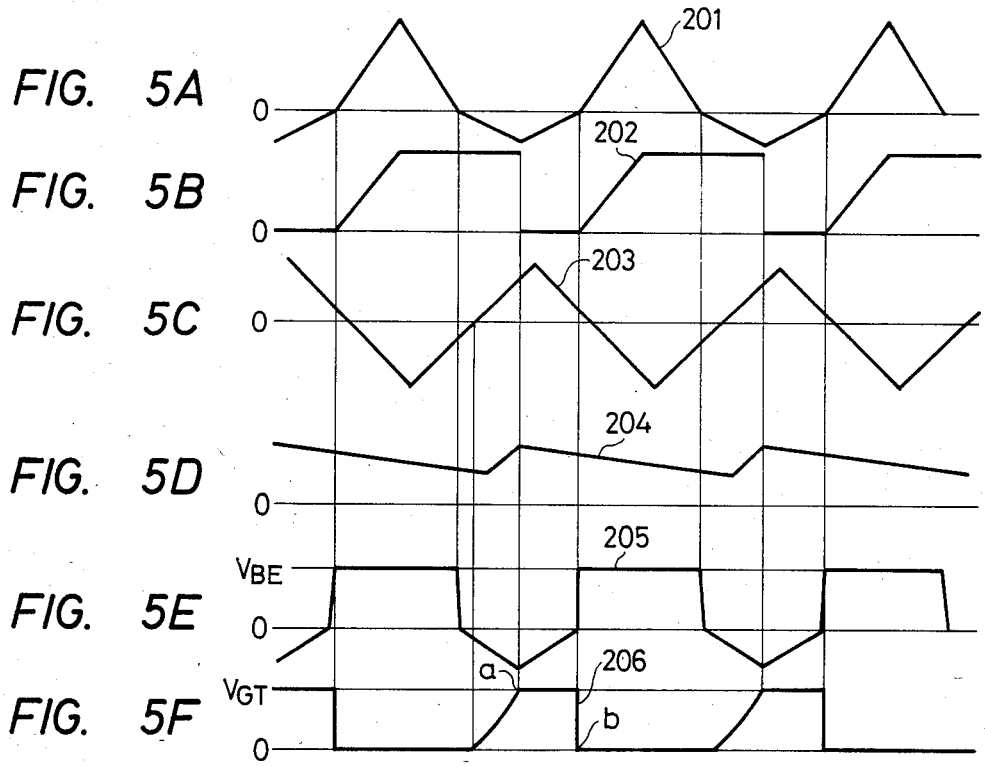
FIGS. 5A through 5F, taken together, are a waveform diagram used for a description of the operation of the second embodiment shown in FIG. 4.

FIGS. 5A through 5F, taken together, as a waveform diagram showing various voltage waveforms in the above-described ignition system. More specifically, FIG. 5A shows the AC output voltage waveform 201 of the generating coil 1, FIG. 5B, the terminal voltage waveform 202 of the capacitor 4, FIG. 5C the AC output voltage waveform 203 of the signaling coil 2, FIG. 5D the terminal voltage waveform 204 of the capacitor 18, FIG. 5E the base-emitter voltage waveform 205 of the transistor 16, and FIG. 5F, the gate-cathode voltage waveform 206 of the thyristor 9. In this diagram, $V_{BE}$ designates the base-emitter forward voltage drop of the transistor 16, and $V_{GT}$ the gate trigger voltage of the thyristor 9.

When the output voltage waveform 203 of the signaling coil 2 rises, the gate-cathode voltage waveform 206 of the thyristor 9 rises also. However, the rise of the waveform 206 is delayed by the action of the delay circuit 15, and the thyristor 9 is triggered at the point a. The amount of delay in the rise of the waveform increases as the speed of rotation of the engine increases. The reason for this is that, as the speed of the engine increases, the rate of rise of the waveform of the signaling coil 2 is increased, and accordingly the action of the delay circuit 15 becomes more effective. Only for the period of time during which the output of the generating coil 1 is zero or positive will the base-emitter voltage waveform 206 of the transistor 16 reach the value $V_{BE}$ and the transistor 16 be rendered conductive. Therefore, with respect to the gate-cathode voltage waveform 206 of the thyristor 9, the capacitor 14 is discharged at the point b, as a result of which the delay circuit 15 is reset to be ready for the next output of the signaling coil 2.

The characteristic curve of the second embodiment of FIG. 4 is similar that (d) indicated in FIG. 3, and thus in the present case also the ignition timing is substantially constant, irrespective of the speed of rotation of the engine.

I claim:

1. An ignition system for an internal combustion engine, comprising:

a magneto, driven by said engine, and having a generating coil and a signaling coil for generating AC outputs in synchronization with rotation of said engine;

an ignition coil;

a first capacitor coupled to be charged by an output of said generating coil;

first switching means for, when rendered conductive, discharging said first capacitor to operate said ignition coil;

a delay circuit, comprising a resistor and a second capacitor, for delaying an output of said signaling coil, an output of said delay circuit being applied to said first switching means to render said first switching means conductive; and second switching means for, after said first capacitor is discharged and in response to outputs of said generating coil and said signaling coil, resetting said delay circuit to fully discharge said second capacitor each time said first capacitor is discharged.

2. The ignition system as claimed in claim 1, wherein said first switching means comprises a thyristor, and wherein said second capacitor coupled between a gate and cathode of said thyristor.

3. The ignition system as claimed in claim 2, wherein said second switching means comprises a transistor having a base coupled to an output of said signaling coil and a collector coupled to said gate of said thyristor.

4. The ignition system as claimed in claim 3, further comprising a series circuit of diodes coupled in parallel with said generating coil, said series circuit of diodes operating to short circuit a half of each cycle of said AC output of said generating coil which does not contribute to charging of said first capacitor, an intermediate point within said series of diodes being coupled to said base of said transistor.

5. An ignition system for an internal combustion engine comprising:

a magneto, driven by said engine, having a generating coil and a signaling coil for generating AC outputs in synchronization with rotation of said engine;

an ignition coil;

a first capacitor coupled to be charged by an output of said generating coil;

first switching means for, when rendered conductive, discharging said first capacitor to operate said ignition coil;

a delay circuit, comprising a resistor and a second capacitor, for delaying an output of said signaling coil, an output of said delay circuit being applied to said first switching means to render said first switching means conductive;

second switching means for resetting said delay circuit to fully discharge said second capacitor each time said first capacitor is discharged;

a third capacitor and a first diode, said first diode coupling said third capacitor to be charged by a half of each cycle of said AC output of said generating coil which does not contribute to charging of said first capacitor, said third capacitor being coupled to said second switching means to render said record switching means conductive when said third capacitor is discharged; and a second diode for passing only said half cycle of said AC output of said generating coil which does not contribute to the charging of said first capacitor, for reversely biasing said second switching means, thereby to render said second switching means nonconductive during said half cycle of said AC output which does not contribute to the charging of said first capacitor.

6. The ignition system as claimed in claim 5, wherein said first switching means comprises a thyristor and a second capacitor coupled between a gate and cathode of said thyristor.

7. The ignition system as claimed in claim 6, wherein said second switching means comprises a transistor having a base coupled through a resistor to one terminal of said third capacitor and coupled through a third diode to one terminal of said generating coil, and a collector connected to said gate of said thyristor.

* * * * *